US006722094B1

(12) United States Patent
Judd et al.

(10) Patent No.: US 6,722,094 B1
(45) Date of Patent: Apr. 20, 2004

(54) INSULATING STRUCTURAL CORES FOR BLOCK

(76) Inventors: Brett Judd, 620 Washington Ave., Pocatello, ID (US) 83201; Gina Judd, 620 Washington Ave., Pocatello, ID (US) 83201

( * ) Notice: Subject to any disclaimer, the term of this patent is extended or adjusted under 35 U.S.C. 154(b) by 0 days.

(21) Appl. No.: 10/082,689

(22) Filed: Feb. 25, 2002

Related U.S. Application Data

(60) Provisional application No. 60/270,615, filed on Feb. 23, 2001.

(51) Int. Cl.[7] ..... E04B 1/00

(52) U.S. Cl. ..... 52/404.1; 52/405.1; 52/405.2; 52/404.4

(58) Field of Search ..... 52/606, 604, 405.1, 52/405.2, 404.4, 309.12, 404.1, 404.2, 309.1, 309.4, 309.5–309.7

(56) References Cited

U.S. PATENT DOCUMENTS 3,204,381 A * 9/1965 Perreton ..... 52/309.12
4,016,693 A * 4/1977 Warren ..... 52/405.1
4,058,948 A * 11/1977 Warren ..... 52/405.1
4,380,887 A * 4/1983 Lee ..... 52/405.1
4,498,266 A 2/1985 Perreton
4,731,279 A * 3/1988 Isshiki ..... 428/159
4,748,782 A * 6/1988 Johnson et al. ..... 52/405.4
4,769,964 A 9/1988 Johnson et al.
5,349,798 A * 9/1994 Gross ..... 52/405.1
5,355,647 A 10/1994 Johnson et al.
5,966,889 A * 10/1999 Zinner ..... 52/606
6,134,853 A * 10/2000 Haener ..... 52/405.2
6,145,261 A * 11/2000 Godfrey et al. ..... 52/302.1
6,233,897 B1 * 5/2001 Jurik ..... 52/604
6,490,837 B1 * 12/2002 Dueck et al. ..... 52/592.6

* cited by examiner

*Primary Examiner*—Jeanette Chapman

(57) ABSTRACT

Improved insulating structural cores for use in self-aligned and leveled insulated drystacked block. Interlocking tongues (10*a*, 10*b*, 10*c*, 10*d*) join with corresponding receiving recesses (14*a*, 14*b*, 14*c*, 14*d*) when block and cores are laid in vertical succession. The interlocking tongues (10*a*, 10*b*, 10*c*, 10*d*) and receiving recesses (14*a*, 14*b*, 14*c*, 14*d*) connect to create a continuous thermal barrier between each block course. The face of relatively smaller insulating structural cores may be molded to create a continuous chase or conduit channel (18*a*, 18*b*, 18*c*).

1 Claim, 6 Drawing Sheets

INSULATING STRUCTURAL CORES FOR BLOCK

REFERENCE TO RELATED APPLICATION

This application claims the benefit of U.S. Provisional Application No. 60/270,615, filed Feb. 23, 2001.

BACKGROUND OF THE INVENTION

1. Field of the Invention

This invention relates to insulating structural cores for self-aligned and leveled insulated drystacked block, and more specifically relates to insulating structural cores having an enhanced ability to reduce thermal energy transfer between blocks, provide alignment and strength to each successive row of block, and allow the installation of electrical conduit within the block cavity.

2. Description of the Prior Art

The known prior art relating to self-aligned and leveled insulated drystacked block cores includes U.S. Pat. No. 4,748,782, U.S. Pat. No. 4,769,964, and U.S. Pat. No. 5,355,647, each issued to Johnson, et al. Disclosed generally in these patents is a method of masonry block construction in which a wall is erected freestanding, receiving internal strength and insulation from molded, form-fitting cores. No mortar is used in the erection of the wall. These patents generally disclose the incorporation of insulating cores that are molded to facilitate the dual purposes of aligning/leveling the block and insulating the block. Each masonry block interlocks laterally with a core. Additionally, the disclosed cores have laterally-spaced interrelating recesses on the bottoms of the cores and laterally-spaced protrusions on the tops of the cores to align blocks in each successive row. Thus, while generally providing for the continuity of insulation across lateral gaps at the ends of each adjoining block, these known designs fail to provide any significant insulating interconnection between the cores of vertically successive rows of block and therefore fail to maintain any meaningful insulating continuity between the vertically successive rows.

Furthermore, while providing an interlock between laterally-adjacent blocks, thereby increasing the wall strength, the cores disclosed in the patents issued to Johnson do not provide substantial structural interconnectivity between each successive row. Although these cores are intended and designed to create a truly aligned and leveled wall, in actual practice masons installing such block in the field must shim blocks to maintain a running alignment. Uncontrollable variations in both blocks and cores create gaps that decrease the alignment and insulating value of the wall. The existence of these gaps is recognized in the abstracts of U.S. Pat. Nos. 4,748,782 and 4,769,964, which state "The intimate contact of the insertable cores permit the formation of open-gapped interlocks between blocks and running courses, which open-gapped interlocks are converted to close-gapped interlocks when a wall erected of such running courses is coated with a surface bonding cement." While adding strength to the overall wall, this bonding cement has little insulating value in comparison to the cores.

U.S. Pat. No. 4,498,266 to A. Perreton, shows efforts to maintain insulating continuity between laterally and vertically adjacent blocks in mortar-jointed construction, a related construction process to the drystack method. However, these cores are incompatible with drystack method blocks. Additionally, the insert of Perreton fails to fully exploit the structural and alignment capabilities of the insert. Furthermore, the insert of Perreton makes no provisions for the necessary inclusion of electrical conduit within the block cavity.

U.S. Pat. No. 5,355,647 to Johnson, discloses the use of elongated vertical nodes that interlock to corresponding recesses in the base of the receiving core. While improving alignment, these nodes do little for the continuity of insulating material across the entire gap between each successive row.

In wall construction utilizing masonry block, whether drystacked or mortared, electrical conduit is run within the hollow cavity of the block. The Background of the Invention of U.S. Pat. No. 4,748,782 discusses the inherent problem of prior art block in the construction process. It states that ". . . prior art construction block was provided with interior passageways suitable for housing subsequently installed electrical conduit. However, unless the mason erecting the wall knew exactly where the electrical runs were to be installed after the construction was complete, the passageways were essentially useless." As seen in FIGS. 13 and 14 of U.S. Pat. No. 4,748,782 to Johnson et al., an attempt has been made to create a block to accept conduit more readily, but no work has been done to provide a core that allows for the inclusion of conduit within the block's hollow cavity. Thus, masons must spend time in the field carving troughs in the conventional cores for conduit to allow the cores to fit within the remaining space in the block It is therefore apparent that the insulating cores described by the prior art fail to adequately provide insulating and structural properties. These cores fail to provide continuity of insulation across all gaps so far as possible. They lack the vertical interconnectivity to provide the most lateral strength possible to the completed structure. Additionally, the cores prove to be problematic in the practice of installing electrical conduit within blocks.

In conclusion, as far as I am aware, no self-aligned and leveled insulated drystacked blocks or insulating cores have been developed which provide an insulated structural core establishing row to row connectivity, continuation of insulation across all gaps, and allowances in the cores for electrical conduit.

SUMMARY OF THE INVENTION

In view of the foregoing disadvantages inherent in the known types of insulating structural cores now present in the prior art, the present invention provides a new insulating structural cores for block construction wherein the same can be utilized for providing an enhanced ability to reduce thermal energy transfer between blocks, alignment and strength to each successive row of block, and the installation of electrical conduit within the block cavity.

To attain these advantages, the core of the present invention generally comprises a body portion having a top, a bottom, a front, a rear, and lateral ends. A forward extension portion of the core is located on the front of the body portion for filling a portion of the void in the block, and has a top, a bottom, and a forward surface. Significantly, the core also includes a vertical interlocking structure for interlocking together cores inserted in adjacent vertical rows of blocks, such that the vertical interlocking structure of a first core is interlockable to the vertical interlocking structure of a second core positioned below the first core, and the vertical interlocking structure of the first core is interlockable to the vertical interlocking structure of a third core located above the first core.

The invention, improved insulating structural cores, may be precisely molded with insulated foam that tightly fits in the interior walls of a self-aligned and leveled insulated drystacked block. One relatively large core and two relatively smaller cores are provided to fit respectively into corresponding cavities in each block. The cores are designed to interlock one with another from top to bottom and to create vertically running chases or channels to accept, for example, electrical conduit. Cores may be made from plastic foam with high thermal energy transfer resistance or "R" value.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Accordingly, the present invention provides several advantages with respect to the prior art. One advantage of the cores of the present invention is the enhancement of the vertical strength of a block wall employing the cores.

An additional advantage of the cores of the present invention is the high thermal energy transfer resistance of the cores for enhancing the thermal energy resistance of a wall employing the cores of the present invention.

A further advantage of the cores of the present invention is the capability to rapidly install the cores around electrical conduit extending through the hollow passages of the blocks while maintaining an intimate relationship of the cores to the block.

Another advantage of the cores of the present invention is the ability of the cores to maintain continuity of insulating material from lower block runs to upper block runs, insomuch as the configuration of the block structure allows.

Yet another advantage of the cores of the present invention is the ability of the cores to add structural strength and density to a wall including the cores.

Still another advantage of the cores of the present invention is ability of the cores to add vertical and lateral strength to the block and enhance the self-alignment and leveled properties of the block.

A still further advantage of the cores of the present invention is the ability to provide the mason with insulating cores that will be easy to install, saving time and labor costs in the building of the structure.

Still further objects and advantages will become apparent from consideration of the ensuing description and drawings.

BRIEF DESCRIPTION OF THE DRAWINGS

The invention will be better understood and objects of the invention will become apparent when consideration is given to the following detailed description thereof. (In the drawings, closely related parts have the same number but a different alphabetic suffix.) Such description makes reference to the annexed drawings wherein.

DESCRIPTION OF PREFERRED EMBODIMENTS

Figure 3:
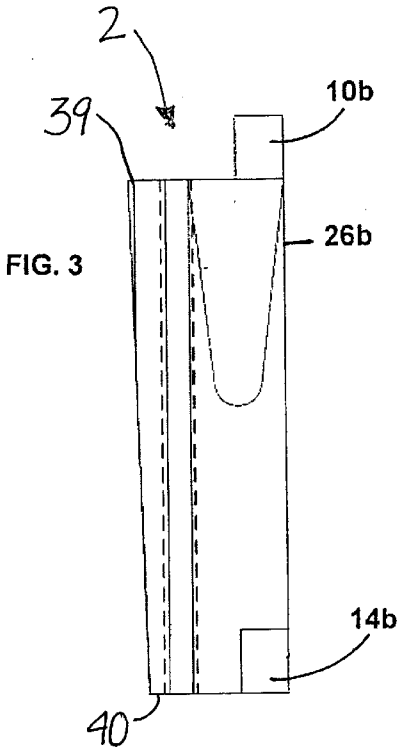
FIG. 3 is a side view of the relatively small core of FIG. 1.

With reference now to the drawings, and in particular to FIGS. 1 through 10 thereof, a new insulating structural cores for block embodying the principles and concepts of the present invention and generally designated by the reference numeral 10 will be described.

As best illustrated in FIGS. 1 through 10, the insulating structural cores generally comprise a core 2, which may be embodied as a relatively small core 12 or a relatively large core 16.

Figure 9:
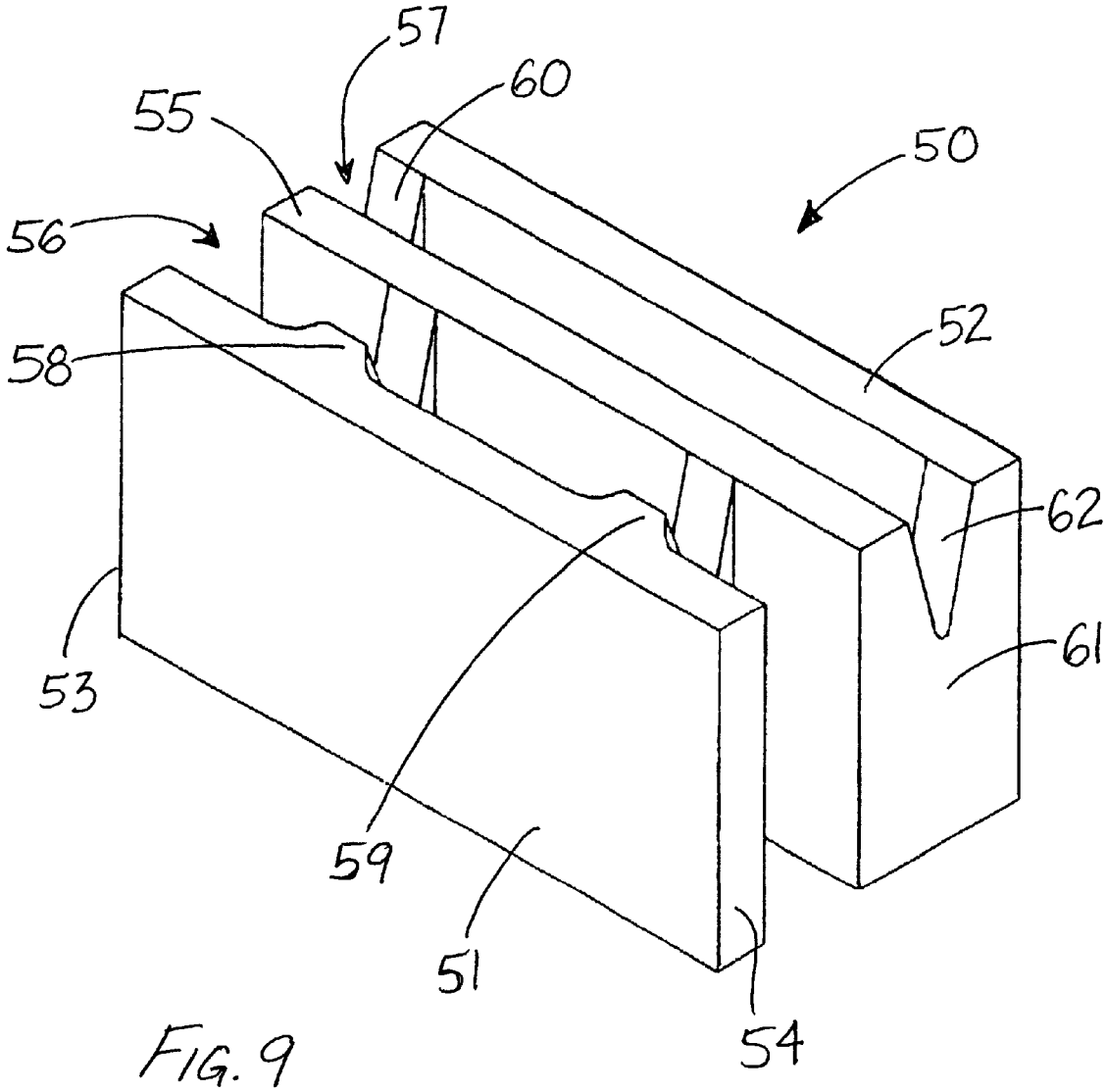
FIG. 9 is a perspective view of one suitable block with which the relatively large and relatively small cores of the present invention may be used. Preferably, the relatively small cores are employed in the voids of the block shown forward and to the left in the figure, and the relatively large cores are employed in the void shown rearward and to the right in the figure.
Figure 10:
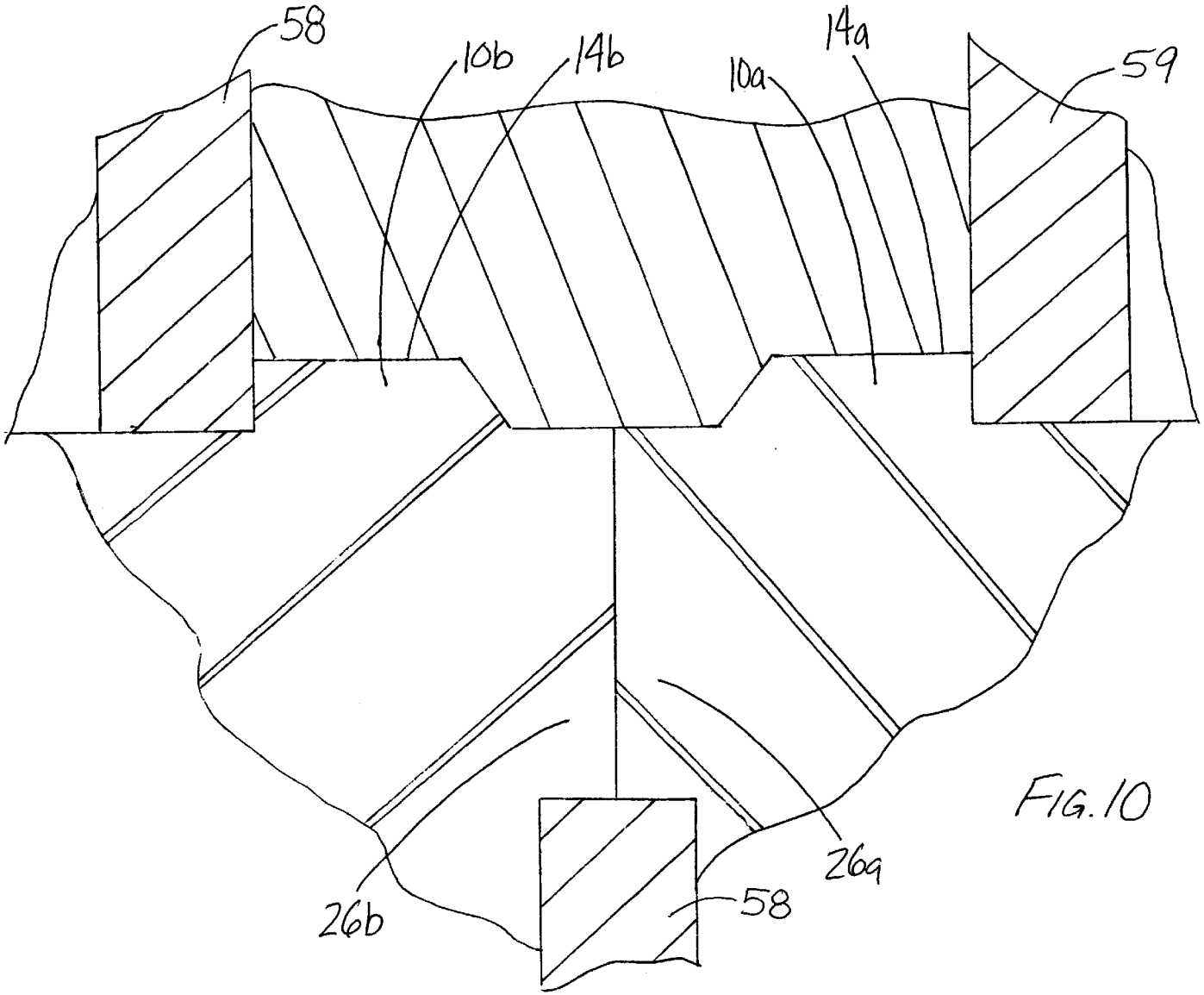
FIG. 10 is a partial sectional view of the cores shown in FIG. 4 along the line 10—10 of FIG. 4.

The core 2 of the invention is provided for inserting in a void of a block. One type of block suitable for use with the invention is illustrated in FIG. 9 of the drawings. The block 50 has a front wall 51, a rear wall 52, and opposite lateral ends 53, 54, and an intermediate wall 55 positioned between the front and rear walls and extending substantially parallel to the front and rear walls. A first void 56 is formed between the front 51 and intermediate 55 walls of the block. A second void 57 is formed between the intermediate 55 and rear 52 walls. A first pair 58, 59 of linking walls may be positioned in the first void 56, and the first pair of linking wall may extend between and link the front 51 and intermediate 55 walls. The first pair of linking walls may be spaced from each other and being spaced from the lateral ends of the block to partition the first void 56 into relatively smaller sections of the first void. A second pair 60, 61 of linking walls may be positioned in the second void 57, and the second pair of linking walls may extend between and link the intermediate 55 and rear 52 walls. The second pair of linking walls may be spaced from each other and each of the linking walls of the second pair may be positioned at one of the lateral ends 53, 54 of the block. The portion of the second void 57 between the second pair 60, 61 of linking walls may be relatively larger than the relatively smaller sections of the first void 56. Each of the linking walls 58 through 61 may have a notch 62 formed therein extending from a top of the block toward a bottom of the block, and the notch may be defined by a pair of converging surfaces that converge toward each other toward the bottom of the block and diverge away from each other toward the top of the block.

Preferred embodiments of the relatively small core 12 and the relatively large core 16 include many of the same or similar features, and therefore the following description will generally describe the core 2, with special note of any features that may or may not be included in one or both of the embodiments.

The core 2 of the invention may include a body portion 30 having a top 31, a bottom 32, a front 33, and a rear 34, and may also have lateral ends 35, 36. The top 31 and bottom 32 may each have surfaces that are oriented substantially parallel to each other, the front 33 and rear 34 may have surfaces oriented substantially parallel to each other, and the lateral ends 35, 36 may have surfaces oriented substantially parallel to each other.

The core 2 may also have a forward extension portion 38 that is located on the front 33 of the body portion and that is suitable for filling a portion of the void in the block. The forward extension portion 38 may have a top 39, a bottom 40, and a forward surface 41. A thickness may be defined between the forward surface 41 of the forward extension portion and the rear 34 of the body portion, and in one preferred embodiment of the invention the thickness is tapered smaller from the top to the bottom to facilitate the insertion of the core into a void. In one illustrative embodiment, a thickness of the forward extension portion 38 is approximately 60% of a thickness of the body portion.

The forward extension portion 38 may include a plurality of compression grooves 22 and ridges 42 that are formed on the forward surface 41 such that the ridges extend forwardly from the forward surface. The grooves 22 and ridges 42 may extend between the top 39 and the bottom 40 of the forward extension portion.

The forward extension portion 38 may also include a conduit channel, or chase 18, for receiving elongate utility elements extending through the void, such as electrical wires, conduit, pipes, etc. The chase is most suitably employed on the relatively smaller core 12, but could optionally be employed on the relatively larger core 16. The chase 18 may be formed in the forward surface of the forward extension portion, and may extend from a top of the forward extension portion to a bottom of the forward extension portion. The chase 18 may extend substantially parallel to the lateral ends of the body portion. The chase 18 may have a depth extending substantially perpendicular to the forward surface 41 of the forward extension portion, and the depth of the chase in one embodiment of the invention may extend to a plane defined by the front 33 of the body portion. Optionally, a plurality of chases 18*a*, 18*b*, and 18*c* may be formed in the forward extension portion 38, and may have a central one of the plurality of chases being substantially centrally located between the lateral ends of the body portion.

A pair of notch filling portions, or alignment tabs, 26*a*, 26*b*, 26*c*, 26*d*, may be provided for positioning in the notches 62 of the linking walls of the block, with each of the notch filling portions 26 extending from one of the lateral ends 35, 36 of the body portion. Each of the notch filling portions may extend from adjacent to the top 31 of the body portion toward the bottom 32 of the body portion.

Significantly, a vertical interlocking structure may be provided as part of the core for interlocking together cores inserted in adjacent vertical rows of blocks. Through the use of the core of the invention, the vertical interlocking structure of a first core is interlockable to the vertical interlocking structure of a second core positioned below the first core and also the vertical interlocking structure of the first core is interlockable to the vertical interlocking structure of a third core located above the first core. The interlocking nature of the cores of the invention not only facilitate alignment of the cores in the block wall, but also provide a significant blockage to air flow and thermal transfer through the wall at the upper and lower boundaries of the block, e.g., between rows or courses of block, which would otherwise be unimpeded by a core that did not extend above or below the upper or lower boundaries of the block.

The vertical interlocking structure may include a bottom interlocking structure that is located on the bottom 32 of the body portion 30 and a top interlocking structure located on the top 31 of the body portion 30. The top and bottom interlocking structures are preferably complementary in nature such that the bottom interlocking structure of the first core is interlockable with the top interlocking structure of the second core when the second core is located in a block below the block in which the first core is inserted, and the top interlocking structure is interlockable with the bottom interlocking structure of the third core when the third core is located in a block above the block in which the first core is inserted. Significantly, the top interlocking structure in the most preferred embodiment has a configuration that is adapted to snugly fit in the bottom interlocking structure.

The bottom interlocking structure of one embodiment of the invention includes a recess, or groove, 14, formed in the bottom 32 of the body portion 30. The recess 14 has a depth extending from the bottom 32 of the body portion toward the top 31 of the body portion. In the case of the relatively small core 12, the depth of the recess may decrease toward a center of the body portion 30 (see FIG. 2). In the case of the relatively large core, the depth of the recess may decrease toward the center of the body portion and toward the nearest laterals end of the body portion (see FIG. 6). The recess 14 may be in communication with the rear 34 of the body portion 30 (see FIGS. 3 and 7). The recess 14 may also be in communication with one of the lateral ends 35, 36 of the body portion (see FIG. 3). In the most preferred embodiments of the invention, the bottom interlocking structure may include a pair of the recesses 14, such as the recesses 14*a* and 14*b* on the relatively small core 12 and the recesses 14*c* and 14*d* on the relatively large core 16.

The top interlocking structure is preferably elongated and extends between the lateral ends 35, 36 of the body portion 30. The top interlocking structure may include an elongated protrusion, or tongue, 10*a*, 10*b*, 10*c*, 10*d* that extends outwardly from the top of the body portion. The top interlocking structure may preferably comprise a pair of tongues, with the relatively small core having the tongues 10*a* and 10*b*, and the relatively large core having the tongues 10*c* and 10*d*. The pair of tongues may be spaced from each other to form a gap therebetween, which may be provided for accommodating and receiving a lower portion of one of the linking walls of a block stacked on the block in which the core in inserted.

In one embodiment of the invention, each of the tongues 10 may include a distal surface 11 located at a furthest location on the tongue 10 from the body portion, and the distal surface may extend substantially parallel to the surface on the top of the body portion. A distance between the distal surface and the top of the body portion may define a height of the tongue, and the height of the tongue may be tapered smaller toward one or both ends of the tongue. Illustratively, the height of the tongue may be tapered smaller toward the lateral ends of the body portion (see FIG. 2), and the height of the tongue may be tapered smaller toward the center of the body portion and toward the lateral ends of the body portion (see FIG. 6). A plurality of side surfaces may extend from the distal surface 11 toward the top of the body portion, and at least one of the side surfaces may extend in a plane oriented at an acute angle with respect to the distal surface to form the tapering height of the tongue, and two of the side surfaces may be angled with respect to the distal surface to form the tapering heights at each of the ends of the tongue.

Figure 1:
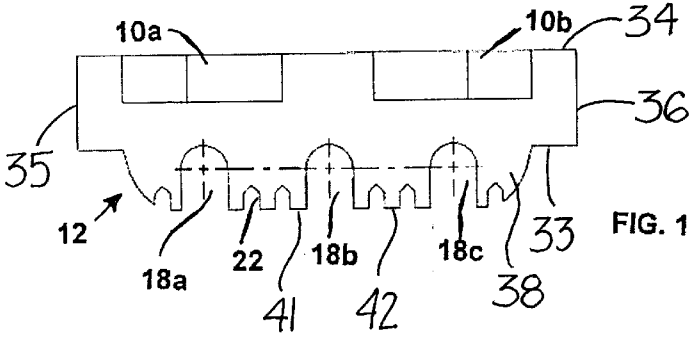
FIG. 1 is a top view of a relatively small insulating structural core of the present invention with conduit channels, tongues, and compression grooves represented.

In greater detail, and in direct reference to the Figures that illustrate feature of two preferred embodiments of the invention, FIG. 1 is a top representation of the relatively small insulating structural core 12. The interlocking tongues 10*a* and 10*b* may be positioned to the rear of the body portion and may be equally spaced so as to avoid contact with the linking walls, or interior webbing, of the receiving block. The chases 18*a*, 18*b*, and 18*c* on the forward surface of core 12 may be positioned so as to provide a continuous vertical channel when the cores 12 are positioned in the block. The compression grooves 22 are positioned in the forward surface 41 of the core 12 to provide for nominal variations in the dimensions of the core 12 and variations in the voids in the block for allowing the core 12 to be molded to fit tightly in the block.

Figure 2:
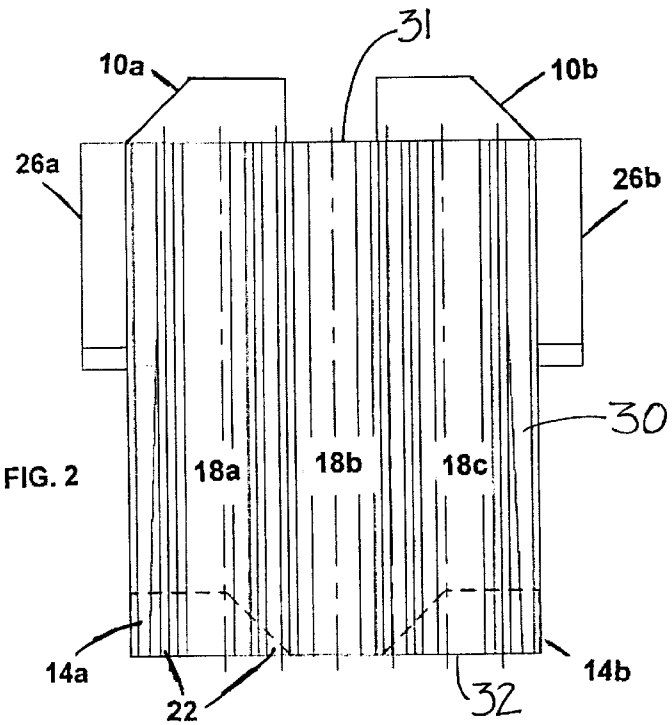
FIG. 2 is a front view of the relatively small core of FIG. 1 with tongues, compression grooves, alignment tabs, and conduit channels represented. The hidden receiving grooves are also depicted in the base of the core in broken lines.

FIG. 2 is a front view of the relatively small core 12 showing an embodiment in which the compression grooves 22 are substantially equally spaced across the forward surface 41, along with chases 18*a*, 18*b*, and 18*c*. Interlocking tongues 10*a* and 10*b* rise above the top 31 of the core 12 so as to provide a continuation of insulating material between each successive row of block. Interlocking tongues 10*a* and 10*b* also provide a structural wall between rows, preventing lateral shift when interconnected with receiving grooves or recesses 14*a* and 14*b* in the corresponding core 12 of the next consecutive row. Each of the lateral ends of the core 12 has a smooth surface and a protruding alignment tab 26*a* and 26*b* which interrelates with the webbing of the block and fills a portion of the notch in the linking wall. These alignment tabs 26*a* and 26*b* may prevent the core 12 from being compressed too deeply into the block.

FIG. 3 is a left side view of the core 12. Receiving groove or recess 14*b* shown in the lower corner is positioned so as to receive interlocking tongue 10*a* when positioned in an adjoining block in a consecutive row. Interlocking tongue 10*b* and alignment tab 26*b* are also represented.

Figure 4:
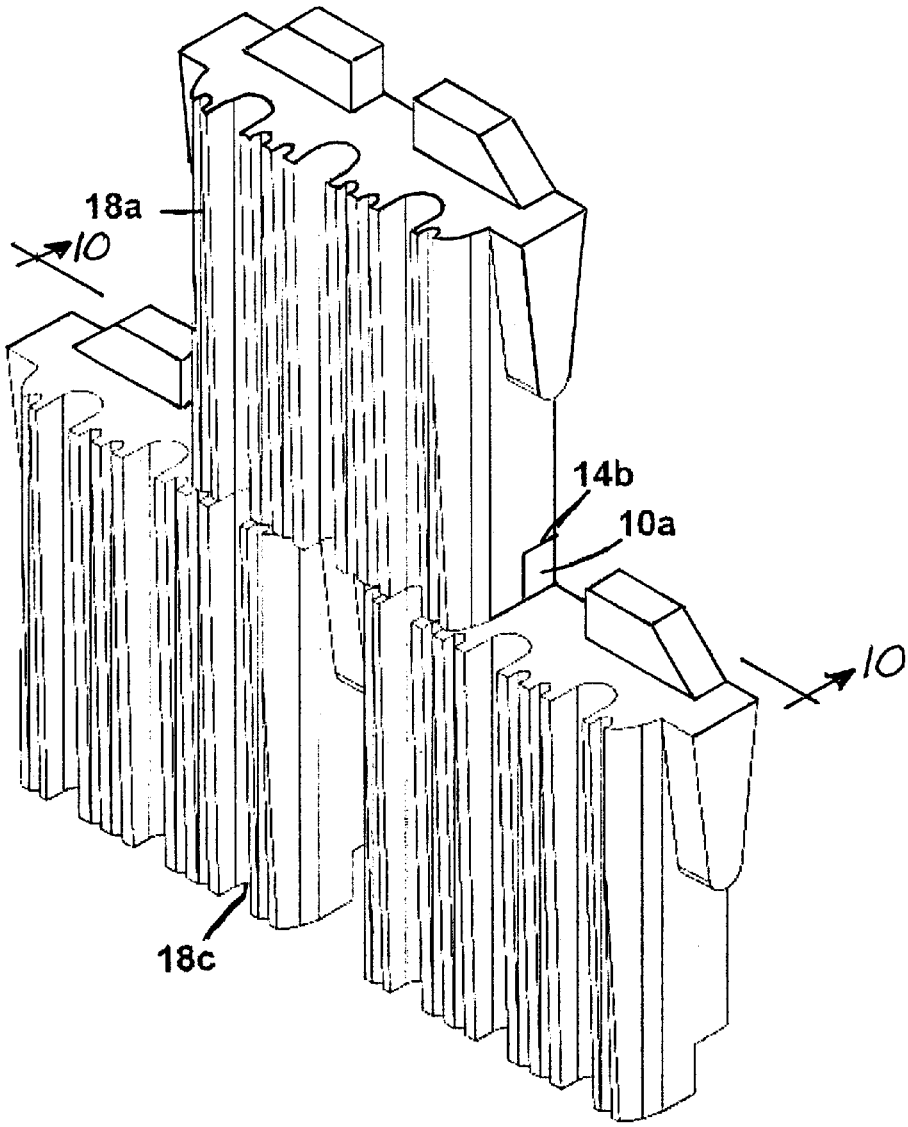
FIG. 4 is a perspective view of three of the relatively small cores of the type illustrated in FIG. 1, and particularly showing the vertical interlock of tongue and groove and the vertical alignment of the conduit channels.

FIG. 4 shows an isometric view of three small cores 12 with the third small core in its interlocking consecutive placement. Interlocking tongue 10*a* is shown tightly interposed within receiving groove 14*b* of upper small core 12. Conduit channel 18*a* in the upper small core 12 is shown creating continuous channel with conduit channel 18*c* in lower small channel.

Figure 5:
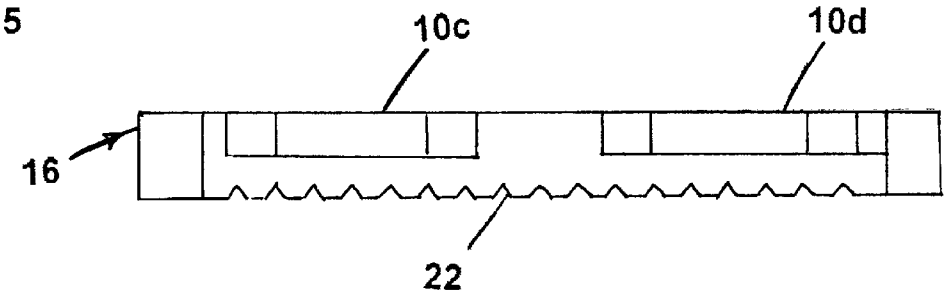
FIG. 5 is a top view of a relatively large insulating structural core of the present invention with compression grooves and tongue represented.

FIG. 5 is a top perspective of the relatively large core 16 with compression grooves 22 shown. Interlocking tongues 10*c* and 10*d* may be positioned at the rear 34 of the body portion of the large core 16 and equally spaced so as to provide a continuation of insulating material between each consecutive row of block without interference of interior webbing or linking walls of the block.

Figure 6:
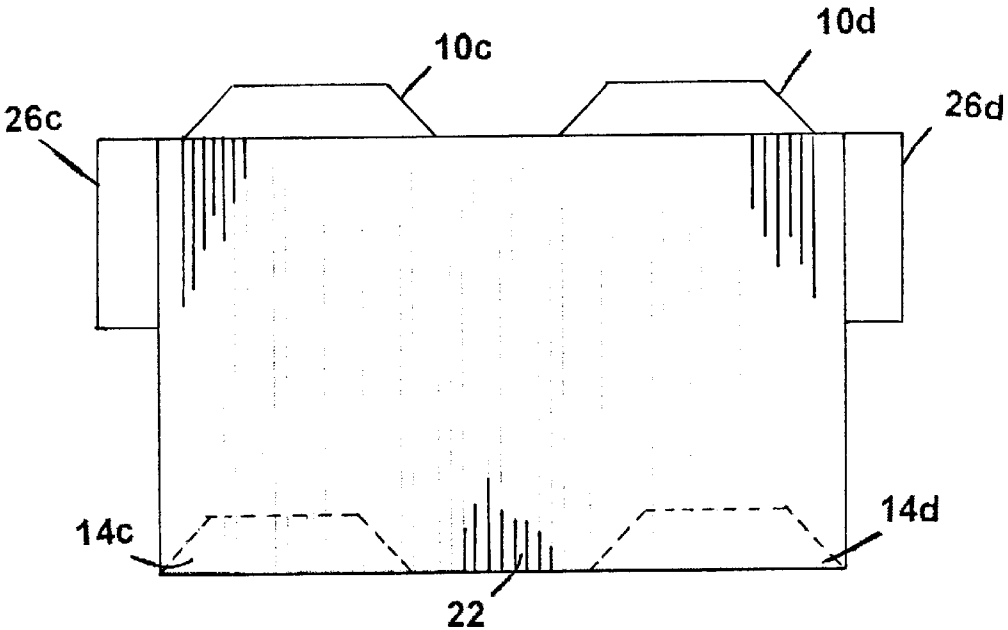
FIG. 6 is a front view of the relatively large core of FIG. 5 with compression grooves, tongue, and alignment tabs represented. The hidden receiving grooves are also depicted in the base of the core in broken lines.

FIG. 6 is a front view perspective of the relatively large core 16 showing the compression grooves 22 across the face substantially equally spaced apart. Interlocking tongues 10*c* and 10*d* rise above the top portion of large core 16 so as to provide a continuation as to provide a structural wall between rows, and assisting the core 12 in preventing lateral shift when interconnected with receiving grooves 14*c* and 14*d* in a corresponding relatively large core located in an adjacent consecutive row. Each left and right lateral ends of the core 16 has a smooth surface and a protruding alignment tab 26*c* and 26*d*. These alignment tabs 26*c* and 26*d* can help prevent the core 16 from being compressed too deeply into block.

Figure 7:
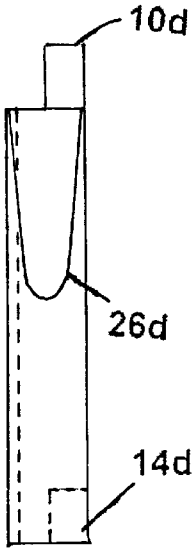
FIG. 7 is a side view of the relatively large core of FIG. 5.

FIG. 7 is a left side view of the core 16. Receiving groove 14*d*, represented in the lower corner, is positioned so as to receive interlocking tongue 10*c* when positioned in adjoining block in an adjacent consecutive row. Interlocking tongue 10*d* and alignment tab 26*d* are also represented.

Figure 8:
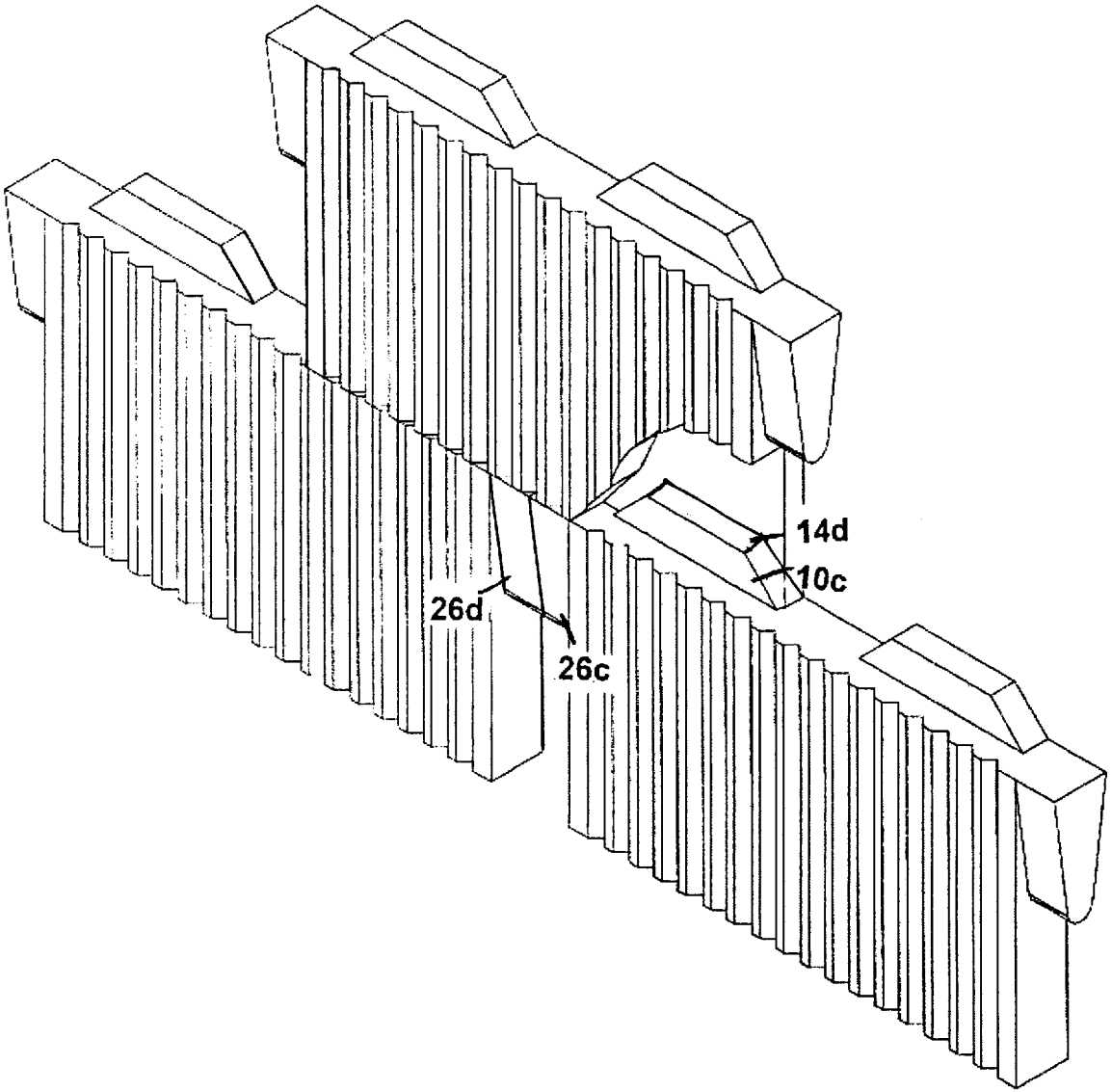
FIG. 8 is a perspective view of three of the relatively large cores of the type illustrated in FIG. 5. A portion of one of the cores is shown broken away to reveal the positioning of one of the tongues of the cores

FIG. 8 shows a perspective view of three cores 16 with the third core 16 in its interlocking consecutive placement. Interlocking tongues 10*c* and 10*d* are shown tightly interposed within receiving groove 14*c* and d of upper large core 16. These structural features would normally be hidden from view. Alignment tabs 26*c* and 26*d* can be seen tightly butted to one another in the center of the lower cores 16.

In use, one may follow the building practices associated with self-aligned and leveled insulated drystacked block. Providing enough insulating structural cores for all blocks in the structure at a ratio of one large core 16 and two small cores 12 to each block used in the wall. Cores 12 and 16 are placed in the respective hollow cavities of the block. The core 16 is placed in the block cavity or void of equal size and shape. Interlocking tongues 10*c* and 10*d* are positioned to the innermost wall of the block. Compression grooves 22 are positioned so as to face the outer wall of the block.

One core 12 is positioned in the closed hollow cavity or void of the same size and shape. Interlocking tongues 10*a* and 10*b* are positioned so as to be adjacent to an inner web or linking wall. The conduit channels 18*a*, 18*b*, and 18*c* are positioned so as to face the interior wall of the block.

When the next block is laid in line, end to end, an open cavity is converted to a closed cavity in each block. A second core 12 is placed in this closed-ended cavity so as to interlock the two adjoining blocks, providing a continuation of insulating material and aligning the two blocks.

When the next consecutive row of block is laid, the following four effects will increase the walls structural strength, thermal energy transfer resistance, and reduce labor time for erecting the wall:

(1) Interlocking tongues 10*a*, 10*b*, 10*c*, and 10*d* provide a channel in which the inner webbing or linking wall of the block is cradled. This cradling prevents the block from shifting front to back and forces the alignment of block with the lower row.

(2) Placement of insulating structural cores in blocks of consecutive row, in manner previously described, will interpose interlocking tongues 10*a*, 10*b*, 10*c*, and 10*d* into corresponding recesses 14*a*, 14*b*, 14*c*, or 14*d*, locking the position of consecutive row vertically and laterally.

(3) Interlock of receiving recesses 14*a*, 14*b*, 14*c*, and d with tongues 10*a*, 10*b*, 10*c* and 10*d* will provide continual insulating material between consecutive rows.

(4) Chases 18*a*, 18*b*, and 18*c* in the cores of a row of blocks will align with corresponding chases 18*a*, 18*b*, or 18*c* in adjacent upper and lower rows of block, creating a continuous vertical passage for the insertion of electrical conduit in the cavity of the block.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A core for inserting in a void of a block, the core comprising:

a body portion having a top, a bottom, a front, and a rear, the body portion also having lateral ends;

a forward extension portion located on the front of the body portion for filling a portion of the void in the block, the forward extension portion having a top, a bottom, and a forward surface; and a vertical interlocking structure for interlocking together cores inserted in adjacent vertical rows of blocks, the vertical interlocking structure of a first core being interlockable to the vertical interlocking structure of a second core positioned below the first core and the vertical interlocking structure of the first core being interlockable to the vertical interlocking structure of a third core located above the first core;

wherein the vertical interlocking structure comprises a bottom interlocking structure located on the bottom of the body portion and a top interlocking structure located on the top of the body portion, the top and bottom interlocking structures being complementary such that the bottom interlocking structure of the first core is interlockable with the top interlocking structure of the second core when the second core is located in a block below the block in which the first core is inserted, and the top interlocking structure is interlockable with the bottom interlocking structure of the third core when the third core is located in a block above the block in which the first core is inserted;

wherein the bottom interlocking structure includes a recess formed in the bottom of the body portion and the top interlocking structure includes a protrusion extending from the top of the body portion;

wherein the protrusion of the top interlocking structure is elongated and extends between the lateral ends of the body portion;

wherein the vertical interlocking structure comprises a bottom interlocking structure located on the bottom of the body portion and a top interlocking structure located on the top of the body portion, the top and bottom interlocking structures being complementary such that the bottom interlocking structure of the first core is interlockable with the top interlocking structure of the second core when the second core is located in a block below the block in which the first core is inserted, and the top interlocking structure is interlockable with the bottom interlocking structure of the third core when the third core is located in a block above the block in which the first core is inserted;

wherein the top interlocking structure has a configuration adapted to snugly fit in the bottom interlocking structure;

wherein the bottom interlocking structure includes a recess formed in the bottom of the body portion and the top interlocking structure includes a protrusion extending from the top of the body portion;

wherein the recess has a depth extending from the bottom of the body portion toward the top of the body portion, the depth of the recess decreasing toward a center of the body portion;

wherein the recess is in communication with one of the lateral ends of the body portion and the recess is in communication with the rear of the body portion, the bottom interlocking structure including a pair of the recesses;

wherein the protrusion of the top interlocking structure is elongated and extends between the lateral ends of the body portion;

wherein the protrusion comprises a pair of tongues, the pair of tongues being spaced from each other to form a gap therebetween for receiving a lower portion of one of the linking walls of a block;

wherein each of the tongues comprise a distal surface at a furthest location on the tongue from the body portion, the distal surface extending substantially parallel to the surface on the top of the body portion;

wherein each of the tongues comprise a plurality of planar side surfaces extending from the distal surface toward the top of the body portion, at least one of the planar side surfaces extending in a plane oriented at an acute angle with respect to a plane of the distal surface;

wherein at least two of the planar side surfaces extend in planes that arc oriented at acute angles with respect to the distal surface;

wherein the forward extension portion includes a plurality of ridges and grooves being formed on the forward surface and extending forwardly from the forward surface, the ridges and grooves extending between the top and the bottom of the forward extension portion;

wherein the forward extension portion includes a chase for receiving elongate utility elements extending through the void, the chase being formed in the forward surface of the forward extension portion, the chase extending from a top of the forward extension portion to a bottom of the forward extension portion;

wherein the chase has a depth extending substantially perpendicular to the forward surface of the forward extension portion, the depth of the chase extending to a plane defined by the front of the body portion;

wherein a plurality of chases is formed in the forward extension portion;

a pair of notch filling portions for positioning in notches in the linking walls of the block, each of the notch filling portions extending from one of the lateral ends of the body portion, each of the notch filling portions extending from adjacent to the top of the body portion toward the bottom of the body portion;

wherein a thickness is defined between the forward surface of the forward extension portion and the rear of the body portion, the thickness being tapered smaller from the top to the bottom to facilitate the insertion of the core into a void;

wherein the top and bottom have surfaces being oriented substantially parallel to each other, the front and rear having surfaces oriented substantially parallel to each other, the lateral ends having surfaces oriented substantially parallel to each other; and wherein the body portion has a depth between the front and the rear of the body portion, and the forward extension portion has a depth between the forward surface of the forward extension portion and the front of the body portion, the depth of the body portion being substantially equal to the depth of the front extension portion.

* * * * *